US012252225B2

(12) United States Patent
Hamada et al.

(10) Patent No.: US 12,252,225 B2
(45) Date of Patent: Mar. 18, 2025

(54) APPARATUS FOR JUDGING ABNORMALITY OF MARINE VESSEL, METHOD FOR JUDGING ABNORMALITY OF MARINE VESSEL, AND MARINE VESSEL

(71) Applicant: YAMAHA HATSUDOKI KABUSHIKI KAISHA, Iwata (JP)

(72) Inventors: Satoru Hamada, Shizuoka (JP); Akihiro Onoue, Shizuoka (JP); Toshio Suzuki, Shizuoka (JP); Masaru Suemori, Shizuoka (JP); Yoshiyuki Kadobayashi, Shizuoka (JP); Manami Oyama, Shizuoka (JP)

(73) Assignee: YAMAHA HATSUDOKI KABUSHIKI KASHA, Shizuoka (JP)

( * ) Notice: Subject to any disclaimer, the term of this patent is extended or adjusted under 35 U.S.C. 154(b) by 167 days.

(21) Appl. No.: 18/204,426

(22) Filed: Jun. 1, 2023

(65) Prior Publication Data

US 2023/0391431 A1 Dec. 7, 2023

(30) Foreign Application Priority Data

Jun. 2, 2022 (JP) ..... 2022-090219

(51) Int. Cl.
*B63B 79/40* (2020.01)
*B63B 79/30* (2020.01)

(52) U.S. Cl.
CPC ..... *B63B 79/30* (2020.01); *B63B 79/40* (2020.01)

(58) Field of Classification Search
CPC ..... B63B 79/30; B63B 79/40; B63B 39/061; B63B 43/00; B63B 1/22
See application file for complete search history.

(56) References Cited

U.S. PATENT DOCUMENTS 7,389,735 B2 * 6/2008 Kaji ..... B63B 21/00 114/230.1
7,702,431 B2 * 4/2010 Kaji ..... B63B 39/061 701/41

(Continued)

FOREIGN PATENT DOCUMENTS

JP 2004-092640 A 3/2004
JP 2007-091115 A 4/2007

OTHER PUBLICATIONS

Skulstad et al., Dead Reckoning of Dynamically Positioned Ships: Using an Efficient Recurrent Neural Network, 2019, IEEE, p. 39-51 (Year: 2019).*

(Continued)

*Primary Examiner* — McDieunel Marc
(74) *Attorney, Agent, or Firm* — Keating & Bennett, LLP

(57) ABSTRACT

An apparatus for judging presence or absence of an abnormality of a marine vessel includes a controller configured or programmed to function as an estimating unit to estimate a marine vessel speed and a pitch angle of a hull of the marine vessel based on a propulsion force of a marine vessel propulsion device and an attitude of the marine vessel propulsion device and a judging unit, and a measuring unit to measure an actual marine vessel speed and an actual pitch angle. The judging unit judges the presence or absence of the abnormality based on at least one of a comparison result between the estimated marine vessel speed estimated by the estimating unit and the actual marine vessel speed measured by the measuring unit or a comparison result between the estimated pitch angle estimated by the estimating unit and the actual pitch angle measured by the measuring unit.

20 Claims, 4 Drawing Sheets

(56) References Cited

U.S. PATENT DOCUMENTS

| | | | | |
|---|---|---|---|---|
| 7,883,292 | B2 * | 2/2011 | Thompson | B63B 21/66 405/173 |
| 8,701,718 | B1 * | 4/2014 | Turiello | G08B 21/18 141/2 |
| 9,278,740 | B1 * | 3/2016 | Andrasko | G05D 1/0875 |
| 10,793,245 | B1 * | 10/2020 | Trotter | G08B 7/06 |
| 11,312,460 | B2 * | 4/2022 | Taylor | B63B 1/121 |
| 11,414,162 | B2 * | 8/2022 | Inoue | G05D 1/0875 |
| 11,453,467 | B2 * | 9/2022 | Inoue | B63B 39/061 |
| 11,554,843 | B2 * | 1/2023 | Inoue | B63H 21/21 |
| 11,787,516 | B2 * | 10/2023 | Inoue | B63H 1/14 701/21 |
| 11,827,325 | B1 * | 11/2023 | Przybyl | B63H 20/10 |
| 2007/0068438 | A1 | 3/2007 | Mizutani | |

OTHER PUBLICATIONS

Dhariwal et al., Experiments in robotic boat localization, 2007, IEEE, p. 1702-1708 (Year: 2007).*

Wang et al., An Effective Model-based Thruster Failure Detection Method for Dynamically Positioned Ships, 2020, IEEE, p. 898-904 (Year: 2020).*

Brodtkorb et al., Sea state estimation using model-scale DP measurements, 2015, IEEE, p. 1-7 (Year: 2015).*

* cited by examiner

APPARATUS FOR JUDGING ABNORMALITY OF MARINE VESSEL, METHOD FOR JUDGING ABNORMALITY OF MARINE VESSEL, AND MARINE VESSEL

CROSS REFERENCE TO RELATED APPLICATIONS

This application claims the benefit of priority to Japanese Patent Application No. 2022-090219, filed on Jun. 2, 2022. The entire contents of this application are hereby incorporated herein by reference.

BACKGROUND OF THE INVENTION

1. Field of the Invention

The present invention relates to an apparatus for judging abnormality of a marine vessel, a method for judging abnormality of a marine vessel, and a marine vessel.

2. Description of the Related Art

Conventionally, techniques for judging the presence or absence of an abnormality of a marine vessel, such as a failure of a marine vessel propulsion device, are known. For example, Japanese Laid-Open Patent Publication (kokai) No. 2004-92640 discloses a technique for judging the presence or absence of an abnormality of a throttle valve. Furthermore, Japanese Laid-Open Patent Publication (kokai) No. 2007-91115 discloses a technique for judging the presence or absence of an abnormality of a sensor.

If an abnormality occurs in a marine vessel propulsion device while a marine vessel such as a planing boat is planing, a marine vessel speed and a pitch angle of the marine vessel usually change. However, even in the case that the marine vessel speed and the pitch angle change, a marine vessel operator does not necessarily become aware of the abnormality. It is conceivable that the marine vessel operator may operate the marine vessel to increase the output of the marine vessel propulsion device so that the marine vessel speed reaches a desired value without being aware of the abnormality.

SUMMARY OF THE INVENTION

Preferred embodiments of the present invention provide apparatuses for judging abnormalities of marine vessels, methods for judging abnormalities of marine vessels, and marine vessels that are each able to judge the presence or absence of an abnormality of a marine vessel.

According to a preferred embodiment of the present invention, an apparatus for judging abnormality of a marine vessel includes a controller configured or programmed to function as an estimating unit to estimate a marine vessel speed and a pitch angle of a hull of the marine vessel based on a propulsion force of a marine vessel propulsion device to propel the hull, and an attitude of the marine vessel propulsion device and a judging unit, and a measuring unit to measure an actual marine vessel speed and an actual pitch angle. The judging unit is configured or programmed to judge the presence or absence of an abnormality of the marine vessel based on at least one of a comparison result between the estimated marine vessel speed estimated by the estimating unit and the actual marine vessel speed measured by the measuring unit or a comparison result between the estimated pitch angle estimated by the estimating unit and the actual pitch angle measured by the measuring unit.

According to another preferred embodiment of the present invention, an apparatus for judging abnormality of a marine vessel includes a controller configured or programmed to function as an estimating unit to estimate a marine vessel speed based on a propulsion force of a marine vessel propulsion device that propels a hull of the marine vessel and an attitude of the marine vessel propulsion device, and a judging unit, and a measuring unit to measure an actual marine vessel speed. The judging unit is configured or programmed to judge the presence or absence of an abnormality of the marine vessel based on a comparison result between the estimated marine vessel speed estimated by the estimating unit and the actual marine vessel speed measured by the measuring unit.

According to another preferred embodiment of the present invention, an apparatus for judging abnormality of a marine vessel includes a controller configured or programmed to function as an estimating unit to estimate a pitch angle of a hull of the marine vessel based on a propulsion force of a marine vessel propulsion device that propels the hull and an attitude of the marine vessel propulsion device, and a judging unit, and a measuring unit to measure an actual pitch angle. The judging unit is configured or programmed to judge the presence or absence of an abnormality of the marine vessel based on a comparison result between the estimated pitch angle estimated by the estimating unit and the actual pitch angle measured by the measuring unit.

According to another preferred embodiment of the present invention, a marine vessel includes the apparatus for judging abnormality of the marine vessel described above.

According to another preferred embodiment of the present invention, a method for judging abnormality of a marine vessel includes estimating a marine vessel speed and a pitch angle of a hull of the marine vessel based on a propulsion force of a marine vessel propulsion device that propels the hull, and an attitude of the marine vessel propulsion device, measuring an actual marine vessel speed and an actual pitch angle, and judging the presence or absence of an abnormality of the marine vessel based on at least one of a comparison result between the estimated marine vessel speed and the actual marine vessel speed or a comparison result between the estimated pitch angle and the actual pitch angle.

According to the preferred embodiments of the present invention described above, the estimated marine vessel speed and the estimated pitch angle of the hull are estimated based on the propulsion force of the marine vessel propulsion device that propels the hull and the attitude of the marine vessel propulsion device, the actual marine vessel speed and the actual pitch angle are measured, and the presence or absence of the abnormality of the marine vessel is judged based on at least one of the comparison result between the estimated marine vessel speed estimated by the estimating unit and the actual marine vessel speed measured by the measuring unit or the comparison result between the estimated pitch angle estimated by the estimating unit and the actual pitch angle measured by the measuring unit. As a result, it is possible to judge the presence or absence of the abnormality of the marine vessel.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
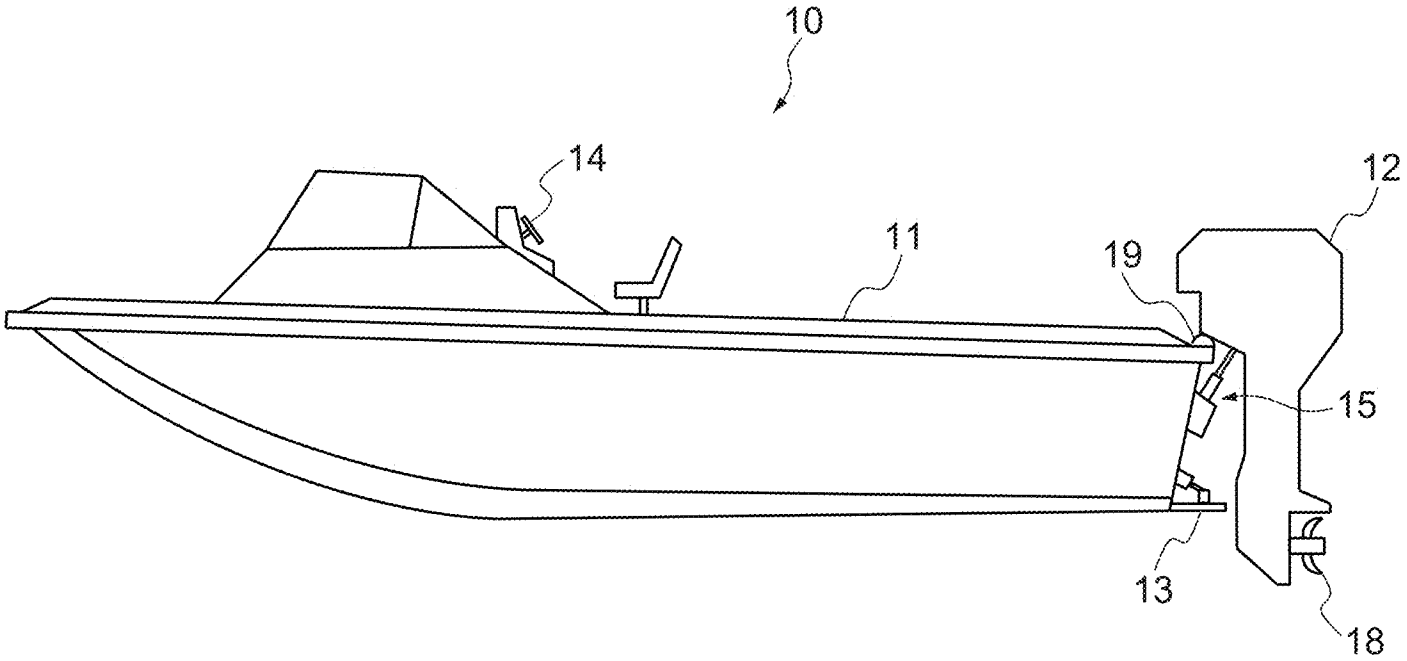
FIG. 1 is a side view of a marine vessel according to a preferred embodiment of the present invention.

FIG. 1 is a side view of a marine vessel 10 according to a preferred embodiment of the present invention. The marine vessel 10 is a planing boat and includes a hull 11, an outboard motor 12 that functions as a marine vessel propulsion device and is mounted on the hull 11, and a plurality of trim tabs 13. A steering wheel 14 is provided near a maneuvering seat of the hull 11.

The outboard motor 12 is mounted on the stern of the hull 11. The outboard motor 12 is propelled by a propeller 18 (including propulsion blades) that is rotated by a driving force of an engine 42 (see FIG. 2). It should be noted that although the marine vessel 10 shown in FIG. 1 includes only one outboard motor 12, the number of the outboard motors 12 included in the marine vessel 10 does not matter. As shown in FIG. 1, the outboard motor 12 is attached to the hull 11 via an attachment unit 19, and rotates about a substantially vertical steering shaft (not shown) in the attachment unit 19 in response to an operation of the steering wheel 14. As a result, the marine vessel 10 is steered. Each trim tab 13 is attached to the stern of the hull 11 and swings about a substantially horizontal swing shaft (not shown) at the stern. As a result, a lift generated at the stern of the hull 11 is adjusted and an attitude of the hull 11 is controlled.

The attachment unit 19 includes a PTT (Power Trim and Tilt) unit 15. The PTT unit 15 rotates the outboard motor 12 about a tilt shaft (not shown) with respect to the hull 11 and changes an inclination angle of the outboard motor 12 with respect to the hull 11 (a trim angle or a tilt angle).

Figure 2:
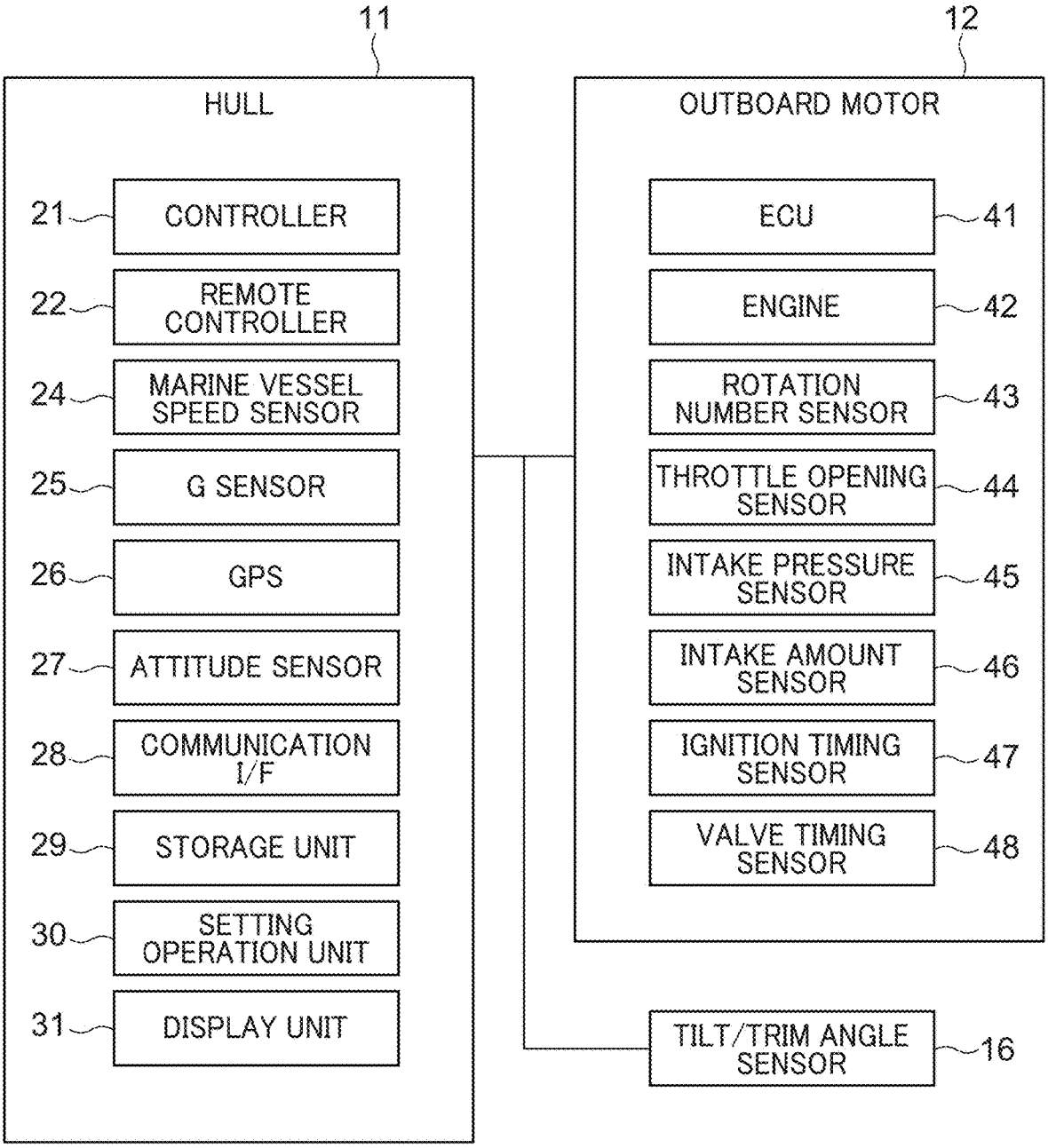
FIG. 2 is a block diagram for schematically explaining respective components included in a marine vessel according to a preferred embodiment of the present invention.

FIG. 2 is a block diagram for schematically explaining respective components included in the marine vessel 10. The hull 11 includes a controller 21, a remote controller 22, a marine vessel speed sensor 24, a G sensor 25, a GPS (Global Positioning System) sensor 26, an attitude sensor 27, a communication I/F (interface) 28, a storage unit 29, a setting operation unit 30, and a display unit 31.

The outboard motor 12 includes an ECU (Engine Control Unit) 41, the engine 42, a rotation number sensor 43, a throttle opening sensor 44, an intake pressure sensor 45, an intake amount sensor 46, an ignition timing sensor 47, and a valve timing sensor 48.

The PTT unit 15 includes a tilt/trim angle sensor 16. The tilt/trim angle sensor 16 detects the inclination angle of the outboard motor 12 with respect to the hull 11. The inclination angle is an angle of the outboard motor 12 based on a position of the lowest point around the tilt shaft. The tilt/trim angle sensor 16 includes, for example, a potentiometer.

The controller 21 is, for example, a BCU (Boat Control Unit). The controller 21 controls operations of the respective components of the marine vessel 10 according to various kinds of programs. The controller 21 includes a CPU (Central Processing Unit) (not shown), a ROM (Read Only Memory) (not shown), a RAM (Random Access Memory) (not shown), a timer (not shown), etc. Control programs executed by the CPU are stored in the ROM. The RAM provides a working area when the CPU executes the control program.

The remote controller 22 includes a lever (not shown). By operating the lever, a marine vessel operator is able to switch a direction of a propulsion force generated by the outboard motor 12 between a forward moving direction and a backward moving direction, and adjust the output of the outboard motor 12 so as to adjust a marine vessel speed of the marine vessel 10. The marine vessel speed sensor 24 measures a speed of the marine vessel 10 (the marine vessel speed of the marine vessel 10). The G sensor 25 measures accelerations acting on the hull 11 in three axial directions. The GPS sensor 26 measures a position of the marine vessel 10 in the earth coordinate system. It should be noted that the controller 21 may obtain the marine vessel speed of the marine vessel 10 from GPS signals.

The attitude sensor 27 includes, for example, a gyro sensor, a magnetic azimuth sensor, etc. Based on signals outputted from the attitude sensor 27, the controller 21 calculates a roll angle of the hull 11, a pitch angle of the hull 11, and a yaw angle of the hull 11. It should be noted that the controller 21 may calculate the roll angle and the pitch angle based on output signals of the G sensor 25. The communication I/F 28 has a communication function via the Internet or the like, and communicates with an external apparatus wirelessly or by wire.

The storage unit 29 is a non-volatile memory. The setting operation unit 30 includes an operation piece (not shown) to perform operations related to marine vessel maneuvering, a PTT operation switch (not shown), a setting operation piece (not shown) to perform various kinds of settings, and an inputting operation piece (not shown) to input various kinds of instructions. The display unit 31 is a display to display various kinds of information, and also functions as a touch panel to accept inputs from the marine vessel operator.

The ECU 41 is a controller for the engine 42 and controls the engine 42 according to control signals issued by the controller 21. The rotation number sensor 43 measures the rotation number of the engine 42. The throttle opening sensor 44 detects an opening of a throttle valve (not shown) of the engine 42. The intake pressure sensor 45 measures an intake pressure of the engine 42.

The intake amount sensor 46 detects an intake air amount in the engine 42. The ignition timing sensor 47 detects an ignition timing in an ignition device (not shown) of the engine 42. The valve timing sensor 48 detects a valve timing (an opening/closing timing) of an intake/exhaust valve (not shown) of the engine 42.

In the marine vessel 10, the respective components 21, 22, 24 to 31, and 41 to 48 described above are connected to each other by a CAN (Control Area Network) that is a network in which a plurality of nodes are individually connected to a bus. The detection results and the measurement results, which are obtained by the components 24 to 27 and 43 to 48, are transmitted to the controller 21. It should be noted that the respective components of the marine vessel 10 may be connected to each other not by the CAN but by a LAN (Local Area Network) such as Ethernet (registered trademark) that provides connections via a network device, or the respective components of the marine vessel 10 may be directly connected to each other.

In addition, the hull 11 or the outboard motor 12 includes various kinds of actuators (not shown). The various kinds of actuators include a mechanism to rotate the outboard motor 12 around the steering shaft, a mechanism to switch a shift position of a forward moving/backward moving switching mechanism (not shown), a mechanism to adjust a throttle opening (the opening of the throttle valve), a mechanism to drive the trim tabs 13, etc. The various kinds of actuators also include actuators to realize automatic pilot (automatic marine vessel maneuvering).

Figure 3:
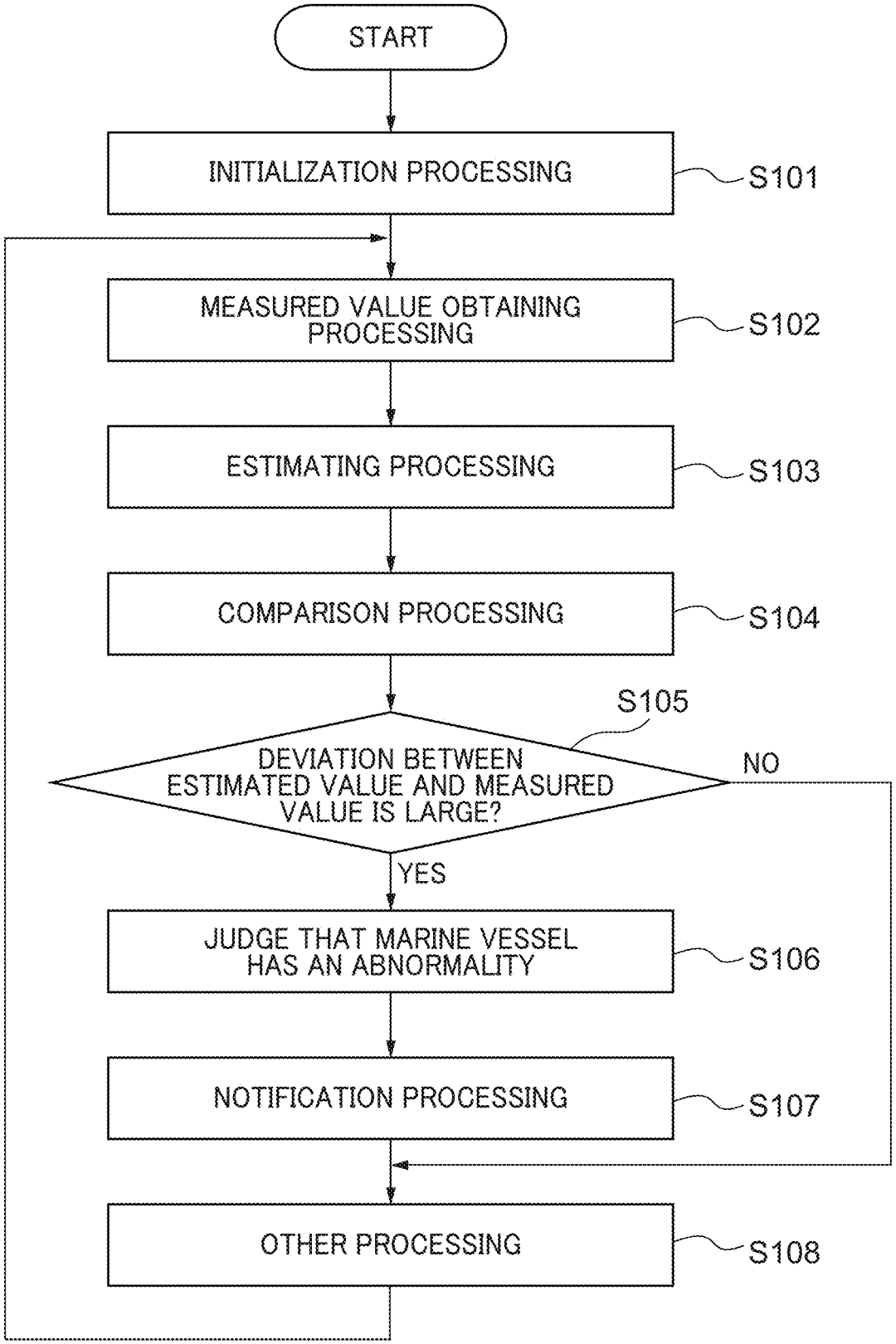
FIG. 3 is a flowchart that shows the flow of an abnormality judging process.

FIG. 3 is a flowchart that shows the flow of an abnormality judging process. In the controller 21, the abnormality judging process is realized by the CPU expanding a program, which is stored in the ROM, to the RAM and executing the program. The abnormality judging process is started, for example, when a main switch (not shown) of the marine vessel 10 is turned on.

In a step S101, the controller 21 executes an initialization process. In the initialization process, the controller 21, for example, obtains fixed information. The fixed information includes hull information and propeller propulsion efficiency (propulsion efficiency of the propeller 18). The propeller propulsion efficiency is determined by multiplying propeller efficiency by hull efficiency.

Here, the hull information includes specifications of the hull 11 (information on bow shape, boat pitch, crew capacity, cargo, fuel, etc.) and environmental conditions (information on waves, tidal currents, and wind). The hull information is stored in the ROM in advance. It should be noted that some of the hull information may be obtained by being inputted by the marine vessel operator.

In a step S102, the controller 21 executes a measured value obtaining process. In the measured value obtaining process, the controller 21 obtains the detection results and the measurement results, which are obtained by a measuring unit (including the sensors 24 to 27, 43 to 48, and 16). As a result, measured values such as the marine vessel speed, the pitch angle, an engine rotation number (the rotation number of the engine 42), the throttle opening, the intake air amount, the ignition timing, the valve timing, and the inclination angle of the outboard motor 12 with respect to the hull 11 (the trim angle or the tilt angle) are obtained. It should be noted that the intake air amount may be estimated based on the intake pressure, the throttle opening, and the valve timing. In addition, it is not necessary to obtain measured values that are not used in subsequent processes.

In a step S103, the controller 21, which functions as an estimating unit, executes a first estimating process and a second estimating process as estimating processes. The first estimating process is a process of estimating a propulsion force. The propulsion force referred to here is the propulsion force (a thrust) generated by the outboard motor 12 functioning as the marine vessel propulsion device to propel the hull 11. The second estimating process is a process of estimating the marine vessel speed and the pitch angle of the hull 11.

First, in the first estimating process, the controller 21 estimates the propulsion force based on an actual engine rotation number measured while the hull 11 is navigating and an actual throttle opening measured while the hull 11 is navigating. At that time, a map 400 (FIG. 4) is referred to. Hereinafter, the propulsion force estimated in the first estimating process will be referred to as "an estimated propulsion force".

Figure 4:
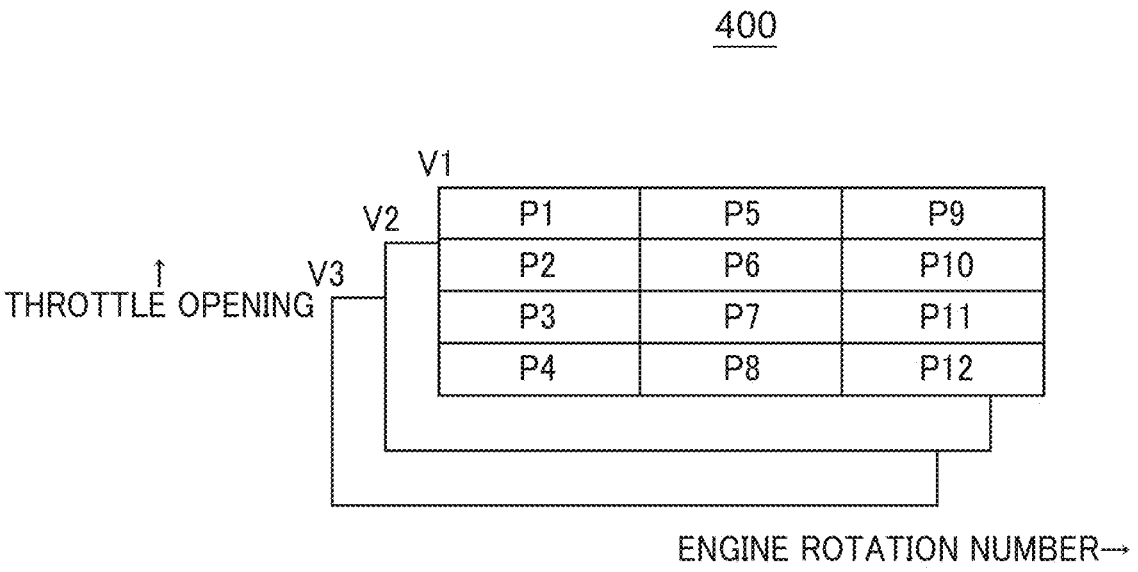
FIG. 4 is a conceptual diagram that shows an example of a map.

FIG. 4 is a conceptual diagram that shows an example of the map 400. The map 400 is information indicating the relationship between the engine rotation number, the throttle opening, the propulsion force, and the marine vessel speed, and is obtained by model learning obtained in advance. The map 400 is, for example, stored in the ROM. The map 400 is a map in which a propulsion force map is provided for each marine vessel speed (V1, V2, V3, . . . ). The propulsion force map is a map in which propulsion forces P (P1 to P12) corresponding to the engine rotation number and the throttle opening are determined.

The controller 21 refers to the propulsion force map corresponding to a measured actual marine vessel speed within the map 400, and determines the propulsion force corresponding to the actual engine rotation number and the actual throttle opening as the estimated propulsion force.

As a modification, the controller 21 may estimate the estimated propulsion force based on an actual intake air amount measured while the hull 11 is navigating and an actual ignition timing measured while the hull 11 is navigating. In this case, a map (not shown) indicating the relationship between the intake air amount, the ignition timing, and an engine output (the output of the engine 42) is obtained in advance and is stored in the ROM. The map indicating the relationship between the intake air amount, the ignition timing, and the engine output is, for example, a map in which an engine output map is provided for each propeller propulsion efficiency. The engine output map is a map in which the engine output corresponding to the intake air amount and the ignition timing is determined.

The controller 21 refers to the engine output map corresponding to the propeller propulsion efficiency obtained in the step S101 within the map indicating the relationship between the intake air amount, the ignition timing, and the engine output, and obtains the engine output corresponding to the actual intake air amount and the actual ignition timing as an estimated engine output. Then, the controller 21 determines the estimated propulsion force based on "the estimated propulsion force=the estimated engine output x the propeller propulsion efficiency". It should be noted that from the viewpoint of simplifying the configuration, it is not essential to provide the engine output map for each propeller propulsion efficiency. On the other hand, the engine output map may be further subdivided and provided for each marine vessel speed, and the estimated propulsion force may be determined also in consideration of the actual marine vessel speed.

Next, in the second estimating process, the controller 21 estimates the marine vessel speed or the pitch angle based on a measured actual attitude of the marine vessel propulsion device, the hull information, and the propulsion force. In this case, a map (not shown) indicating the relationship between the propulsion force, the attitude of the marine vessel propulsion device, and the marine vessel speed is obtained in advance and is stored in the ROM. In addition, a map (not shown) indicating the relationship between the propulsion force, the attitude of the marine vessel propulsion device, and the pitch angle is obtained in advance and is stored in the ROM. In this way, a map, in which "the marine vessel speed or pitch angle" corresponding to the attitude of the marine vessel propulsion device and the propulsion force is determined, is provided for each hull information.

It should be noted that "the attitude of the marine vessel propulsion device" corresponds to, for example, the inclination angle of the outboard motor 12 with respect to the hull 11 (the trim angle or the tilt angle). It should be noted that "the attitude of the marine vessel propulsion device" may include a setback. Alternatively, in the case that a vertical position of the outboard motor 12 with respect to the hull 11 is variable, "the attitude of the marine vessel propulsion device" may include a vertical movement amount (a lift amount) of the outboard motor 12 from a reference position.

It should be noted that the hull information is classified in advance into a plurality of categories according to combinations, and the hull information of the category to which the hull 11 belongs is used when referring to the map. The controller 21 refers to a map corresponding to the hull information of the category to which the hull 11 belongs, and determines "the marine vessel speed or pitch angle" corresponding to the actual attitude of the marine vessel propulsion device and the propulsion force as an estimated "marine vessel speed or pitch angle". It should be noted that as the propulsion force used when referring to the map, the estimated propulsion force may be used, or a measured value (an actual propulsion force) may be used.

In a step S104, the controller 21 compares the marine vessel speed estimated in the step S103 and the actual marine vessel speed measured in the step S102. In addition, the controller 21 compares the pitch angle estimated in the step S103 and the actual pitch angle measured in the step S102.

In a step S105, the controller 21 judges whether or not a deviation between the estimated value and the measured value is large based on comparison results obtained in the step S104. Specifically, the controller 21 judges whether or not a first event or a second event has occurred, and in the case that at least one of the first event or the second event has occurred, judges that the deviation between the estimated value and the measured value is large.

Here, the first event is an event in which the estimated marine vessel speed and the actual marine vessel speed deviate by a predetermined speed or more. The second event is an event in which the estimated pitch angle and the actual pitch angle deviate by a predetermined angle or more. The predetermined speed and the predetermined angle are stored in the ROM or the like in advance. In the case that neither the first event nor the second event has occurred as a result of the judgment in the step S105, the controller 21 advances the abnormality judging process to a step S108. On the other hand, in the case that at least one of the first event or the second event has occurred as the result of the judgment in the step S105, the controller 21 advances the abnormality judging process to a step S106.

In the step S106, as a result of judging the presence or absence of an abnormality of the marine vessel 10, the controller 21, which functions as a judging unit, judges that there is the abnormality of the marine vessel 10. It should be noted that as the result of judging the presence or absence of the abnormality of the marine vessel 10, the controller 21 may judge that there is the abnormality in the outboard motor 12. Alternatively, as the result of judging the presence or absence of the abnormality of the marine vessel 10, the controller 21 may judge that there is the abnormality in the hull 11 or the propeller 18. This is because when, for example, shellfish adhere to the hull 11 or when the propeller 18 is damaged, the marine vessel speed and the pitch angle will change. It should be noted that the abnormality of the propeller 18 is included in the abnormality of the outboard motor 12 and the abnormality of the outboard motor 12 is included in the abnormality of the marine vessel 10.

In a step S107, the controller 21 executes a notification process to notify that it has been judged that there is the abnormality. Notification is carried out by displaying a message or a mark on the display unit 31. It should be noted that the notification may be carried out by at least one of a display or a sound. When performing the notification, the controller 21 may make a notification mode in the case that only one of the first event or the second event has occurred different from a notification mode in the case that both the first event and the second event have occurred. For example, the notification mode in the case that both the first event and the second event have occurred may be emphasized to make it easier to be understood than the notification mode in the case that only one of the first event or the second event has occurred. This is because the case that both the first event and the second event have occurred is considered highly probable that there is the abnormality. It should be noted that the notification may be performed in the case that both the first event and the second event have occurred, and the notification may not be performed in the case that only one of the first event or the second event has occurred.

In the step S108, the controller 21 executes other processes and then returns the abnormality judging process to the step S102. In "the other processes" referred to here, for example, depending on receiving an end instruction from the marine vessel operator, a process such as ending the abnormality judging process is executed.

According to a preferred embodiment of the present invention, the marine vessel speed and the pitch angle of the hull 11 are estimated based on the propulsion force (the thrust) of the outboard motor 12 and the inclination angle of the outboard motor 12 (the attitude of the marine vessel propulsion device). In addition, the actual marine vessel speed and the actual pitch angle are measured. The presence or absence of the abnormality of the marine vessel 10 is judged based on the comparison result between the estimated marine vessel speed and the actual marine vessel speed and the comparison result between the estimated pitch angle and the actual pitch angle. As a result, it is possible to judge the presence or absence of the abnormality of the marine vessel 10.

In particular, in the case that at least one of the first event or the second event has occurred, it is judged that there is the abnormality of the marine vessel 10, so that overlooking of the abnormality is reduced or prevented.

Therefore, it is possible to prevent the marine vessel operator from operating the marine vessel 10 to increase the output of the marine vessel propulsion device so that the marine vessel speed reaches a desired value without being aware of the abnormality.

In addition, in the case of being judged that there is the abnormality of the marine vessel 10, since it is judged that there is the abnormality of the marine vessel 10 is notified, it is possible to inform that the abnormality has occurred in the marine vessel 10.

In addition, by making the notification mode in the case that only one of the first event or the second event has occurred different from the notification mode in the case that both the first event and the second event have occurred, it is possible to inform the reliability of the judgment of the presence or absence of the abnormality.

In addition, in the abnormality judgment of the marine vessel 10, the judgment accuracy is particularly high when the marine vessel 10 is planing.

It should be noted that from the viewpoint of simplifying the configuration, in the step S105, only the presence or absence of the occurrence of either the first event or the second event may be judged, and whether or not the deviation is large (whether or not there is the abnormality of the marine vessel 10) may be judged based on the result of judging only the presence or absence of the occurrence of either the first event or the second event.

It should be noted that the marine vessel propulsion device to propel the hull 11 is not limited to the outboard motor 12 using the engine 42, and as the marine vessel propulsion device to propel the hull 11, a marine vessel propulsion device using an electric motor may be used. In the case that a marine vessel propulsion device using an electric motor is used as the marine vessel propulsion device to propel the hull 11, the propulsion force (the thrust) of the marine vessel propulsion device corresponds to a command current value.

It should be noted that the marine vessel is not limited to the above-described one as long as the attitude of the marine vessel propulsion device is able to be changed. Therefore, depending on the type of the marine vessel, preferred embodiments of the present invention are able to be applied to a PWC (Personal Watercraft), a marine vessel equipped with an inboard/outboard motor, or the like.

Although the present invention has been described in detail based on the preferred embodiments described above, the present invention is not limited to these specific preferred embodiments, and various preferred embodiments within the scope not deviating from the gist of the present invention are also included in the present invention.

The present invention is also able to be implemented by a process of supplying a program that realizes one or more functions of the above-described preferred embodiments to a system or an apparatus via a network or a non-transitory storage medium, and one or more processors of a computer of the system or the apparatus reading out the program and executing it. The above program and a storage medium storing the above program may embody the present invention. In addition, the present invention is also able to be implemented by a circuit (for example, an ASIC (application specific integrated circuit)) that implements one or more functions.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An apparatus for judging abnormality of a marine vessel, the apparatus comprising:

a controller configured or programmed to function as:

an estimating unit to estimate a marine vessel speed and a pitch angle of a hull of the marine vessel based on a propulsion force of a marine vessel propulsion device to propel the hull and an attitude of the marine vessel propulsion device; and a judging unit; and a measuring unit to measure an actual marine vessel speed and an actual pitch angle; wherein the judging unit is configured or programmed to judge the presence or absence of an abnormality of the marine vessel based on at least one of a comparison result between the estimated marine vessel speed estimated by the estimating unit and the actual marine vessel speed measured by the measuring unit or a comparison result between the estimated pitch angle estimated by the estimating unit and the actual pitch angle measured by the measuring unit.

2. The apparatus for judging abnormality of the marine vessel according to claim 1, wherein in a case that at least one of a first event in which the estimated marine vessel speed and the actual marine vessel speed deviate by a predetermined speed or more or a second event in which the estimated pitch angle and the actual pitch angle deviate by a predetermined angle or more has occurred, the judging unit is configured or programmed to judge that there is the abnormality of the marine vessel.

3. The apparatus for judging abnormality of the marine vessel according to claim 1, wherein in a case that the judging unit judges that there is the abnormality of the marine vessel, the judging unit is configured or programmed to notify that there is the abnormality of the marine vessel.

4. The apparatus for judging abnormality of the marine vessel according to claim 2, wherein in a case that the judging unit judges that there is the abnormality of the marine vessel, the judging unit is configured or programmed to provide a notification that there is the abnormality of the marine vessel; and the judging unit is configured or programmed to operate in a notification mode in a case that only one of the first event or the second event has occurred different from a notification mode in a case that both the first event and the second event have occurred.

5. The apparatus for judging abnormality of the marine vessel according to claim 1, wherein the marine vessel propulsion device includes an engine; and the estimating unit is configured or programmed to estimate the propulsion force based on an actual engine rotation number measured while the hull is navigating and an actual throttle opening measured while the hull is navigating.

6. The apparatus for judging abnormality of the marine vessel according to claim 5, wherein the estimating unit is configured or programmed to refer to information indicating a relationship between engine rotation number, throttle opening, propulsion force, and marine vessel speed, and to estimate the propulsion force based on the actual engine rotation number, the actual throttle opening, the actual marine vessel speed, and the information.

7. The apparatus for judging abnormality of the marine vessel according to claim 1, wherein when estimating the estimated marine vessel speed or the estimated pitch angle, the estimating unit is configured or programmed to:

refer to information indicating a relationship between hull information, propulsion force, attitude of the marine vessel propulsion device, and marine vessel speed or pitch angle; and estimate the marine vessel speed or the pitch angle based on hull information of the hull, the propulsion force, an actual attitude of the marine vessel propulsion device, and the information.

8. The apparatus for judging abnormality of the marine vessel according to claim 1, wherein the marine vessel propulsion device includes a propeller and an engine to rotate the propeller;

the estimating unit is configured or programmed to estimate the propulsion force based on an actual intake air amount measured while the hull is navigating and an actual ignition timing measured while the hull is navigating; and the estimating unit is configured or programmed to refer to information indicating a relationship between intake air amount, ignition timing, and output of the engine, and to estimate the propulsion force based on propulsion efficiency of the propeller, the actual intake air amount, the actual ignition timing, and the information.

9. The apparatus for judging abnormality of the marine vessel according to claim 1, wherein the attitude of the marine vessel propulsion device includes a trim angle.

10. The apparatus for judging abnormality of the marine vessel according to claim 1, wherein the judging unit is configured or programmed to judge the presence or absence of an abnormality of the hull or the presence or absence of an abnormality of a propeller of the marine vessel propulsion device as the presence or absence of the abnormality of the marine vessel.

11. An apparatus for judging abnormality of a marine vessel, the apparatus comprising:

a controller configured or programmed to function as:

an estimating unit to estimate a marine vessel speed based on a propulsion force of a marine vessel propulsion device to propel a hull of the marine vessel and an attitude of the marine vessel propulsion device; and a judging unit; and a measuring unit to measure an actual marine vessel speed; wherein the judging unit is configured or programmed to judge the presence or absence of an abnormality of the marine vessel based on a comparison result between the estimated marine vessel speed estimated by the estimating unit and the actual marine vessel speed measured by the measuring unit.

12. The apparatus for judging abnormality of the marine vessel according to claim 11, wherein in a case that the estimated marine vessel speed and the actual marine vessel speed deviate by a predetermined speed or more, the judging unit is configured or programmed to judge that there is the abnormality of the marine vessel.

13. The apparatus for judging abnormality of the marine vessel according to claim 11, wherein in a case that the judging unit judges that there is the abnormality of the marine vessel, the judging unit is configured or programmed to provide a notification that there is the abnormality of the marine vessel.

14. An apparatus for judging abnormality of a marine vessel, the apparatus comprising:

a controller configured or programmed to function as:

an estimating unit to estimate a pitch angle of a hull of the marine vessel based on a propulsion force of a marine vessel propulsion device to propel the hull and an attitude of the marine vessel propulsion device; and a judging unit; and a measuring unit to measure an actual pitch angle; wherein the judging unit is configured or programmed to judge the presence or absence of an abnormality of the marine vessel based on a comparison result between the estimated pitch angle estimated by the estimating unit and the actual pitch angle measured by the measuring unit.

15. The apparatus for judging abnormality of the marine vessel according to claim 14, wherein in a case that the estimated pitch angle and the actual pitch angle deviate by a predetermined angle or more, the judging unit is configured or programmed to judge that there is the abnormality of the marine vessel.

16. The apparatus for judging abnormality of the marine vessel according to claim 14, wherein in a case that the judging unit judges that there is the abnormality of the marine vessel, the judging unit is configured or programmed to provide a notification that there is the abnormality of the marine vessel.

17. A marine vessel comprising:

the apparatus for judging abnormality of the marine vessel according to claim 1.

18. A marine vessel comprising:

the apparatus for judging abnormality of the marine vessel according to claim 11.

19. A marine vessel comprising:

the apparatus for judging abnormality of the marine vessel according to claim 14.

20. A method for judging abnormality of a marine vessel comprising:

estimating a marine vessel speed and a pitch angle of a hull of the marine vessel based on a propulsion force of a marine vessel propulsion device that propels the hull and an attitude of the marine vessel propulsion device;

measuring an actual marine vessel speed and an actual pitch angle; and judging the presence or absence of an abnormality of the marine vessel based on at least one of a comparison result between the estimated marine vessel speed and the actual marine vessel speed or a comparison result between the estimated pitch angle and the actual pitch angle.

* * * * *